US005772506A

United States Patent [19]

Marks et al.

[11] Patent Number: 5,772,506

[45] Date of Patent: Jun. 30, 1998

[54] VIDEO POKER GOLD CARD GAME AND COMPUTER SYSTEM FOR INPLEMENTING SAME

[75] Inventors: Howard M. Marks, Westport, Conn.; Anthony M. Singer, Brooklyn, N.Y.

[73] Assignee: PTT, LLC, Westport, Conn.

[21] Appl. No.: 747,800

[22] Filed: Nov. 8, 1996

[51] Int. Cl.[6] ..... A63F 1/00

[52] U.S. Cl. ..... 463/13; 273/292

[58] Field of Search ..... 463/13, 12, 17, 463/18, 26, 27; 273/292, 309, 274

[56] References Cited

U.S. PATENT DOCUMENTS

| | | | |
|---|---|---|---|
| 4,743,022 | 5/1988 | Wood | 463/13 |
| 4,948,134 | 8/1990 | Suttle et al. | 463/13 |
| 5,013,049 | 5/1991 | Tomaszewski | 273/292 |
| 5,098,107 | 3/1992 | Boylan et al. | 273/292 |
| 5,100,137 | 3/1992 | Fulton | 463/13 |
| 5,118,109 | 6/1992 | Gumina | 273/139 |
| 5,255,915 | 10/1993 | Miller | 463/13 |
| 5,294,128 | 3/1994 | Marquez | 273/292 |
| 5,314,194 | 5/1994 | Wolf | 273/292 |
| 5,322,295 | 6/1994 | Cabot et al. | 273/292 |
| 5,382,025 | 1/1995 | Sklansky et al. | 273/292 |
| 5,401,024 | 3/1995 | Simunek | 463/18 |
| 5,407,199 | 4/1995 | Gumina | 273/139 |
| 5,415,404 | 5/1995 | Joshi et al. | 463/13 |
| 5,431,407 | 7/1995 | Hofberg et al. | 273/292 |
| 5,437,451 | 8/1995 | Fulton | 463/13 |
| 5,489,101 | 2/1996 | Moody | 273/292 |
| 5,639,088 | 6/1997 | Schneider | 463/13 |

*Primary Examiner*—Benjamin H. Layno
*Attorney, Agent, or Firm*—Pepper Hamilton LLP

[57] ABSTRACT

A modified card game provides a player the ability to sequentially become eligible for a bonus round of play. The game includes dealing a set of cards to the player for playing the modified card game in accordance with a predetermined number of positions, determining whether a designated card appears in cards dealt to the player, and if so, assigning a position corresponding to the dealt card with an indicator, and repeating this process until the card game is completed. The game also includes determining whether all of the predetermined number of positions have been assigned with the indicator, and if so, playing the modified card game in accordance with a bonus round for enhanced enjoyment/excitement.

18 Claims, 19 Drawing Sheets

| Royal Flush | 1st Coin | 2nd Coin | 3rd Coin | 4th Coin | 5th Coin | Golden Bonus |
|---|---|---|---|---|---|---|
| | 250 | 500 | 750 | 1000 | 5000 | 25000 |
| Straight Flush | 50 | 100 | 150 | 200 | 250 | 1250 |
| 4 of a kind | 25 | 50 | 75 | 100 | 125 | 625 |
| Full House | 9 | 18 | 27 | 36 | 45 | 225 |
| Flush | 6 | 12 | 18 | 24 | 30 | 150 |
| Straight | 4 | 8 | 12 | 16 | 20 | 100 |
| 3 of a kind | 3 | 6 | 9 | 12 | 15 | 75 |
| 2 pair | 2 | 4 | 6 | 8 | 10 | 50 |
| Pair of Kings or better | 1 | 2 | 3 | 4 | 5 | 25 |

Fig. 1

VIDEO POKER GOLD CARD GAME AND COMPUTER SYSTEM FOR INPLEMENTING SAME

RELATED APPLICATIONS

This application claims priority from U.S. provisional patent application Ser. No. 60/023,745, filed on Aug. 8, 1996, entitled "GO-FOR-THE-GOLD CARD GAME," incorporated herein by reference.

TECHNICAL FIELD

The present invention relates generally to games, and more particularly, to card games and a computer system for playing same.

BACKGROUND ART

The growth of the gaming industry, in particular, gambling casinos has been very significant over the last decade. The industry has come to recognize the need for new games and new gambling concepts. It also recognizes that the new technologies available need to be integrated in order to improve their gaming environment. It also recognizes the need to become a more efficient gaming provider.

The state gaming control boards of Nevada and New Jersey (which have traditionally been slow to approve any new games or gambling concepts) have changed their philosophy so dramatically that today they actively encourage the trial and acceptance of new games and gambling concepts. The problem with introducing new games has always been the basic criteria for mass-market gambling:

Easy-to-learn game rules.

Strategies must be easy to master and not favor "the expert" disproportionately.

Games must have a short duration between the start (the bet) and the finish (the payoff).

The payoff structure, that is, what can be won by a lucky player must be enticing.

The game must be fair, that is, the casino should not have an unreasonable advantage.

The game must be "secure", that is, protected from cheating and tampering.

The casino's "win" must be demonstrated to be worthwhile, that is, the "win per machine per month" must at least compare favorably to that of the "slots".

Over the years, there have been many different types of games that have attempted to satisfy the demands of the gaming industry. These games have ranged the gamut from those involving great mental prowess to games involving merely chance. Nevertheless, there is still a strong interest in game concepts that create real excitement.

One game of interest over the years is poker. Various attempts have been made to enhance play of poker over the years. Examples of such attempts are described in the following U.S. patent references, all of which are hereby incorporated by reference:

U.S. Pat. No. 4,743,022; Wood

U.S. Pat. No. 4,948,134; Suttle et al.

U.S. Pat. No. 5,013,049; Tomaszewski

U.S. Pat. No. 5,100,137; Fulton

U.S. Pat. No. 5,118,109; Gumina

U.S. Pat. No. 5,255,915; Miller

U.S. Pat. No. 5,294,128; Marquez

U.S. Pat. No. 5,314,194; Wolf

U.S. Pat. No. 5,382,025; Sklansky et al.

U.S. Pat. No. 5,407,199; Gumina

U.S. Pat. No. 5,415,404; Joshi et al.

U.S. Pat. No. 5,431,407; Hofberg et al.

U.S. Pat. No. 5,437,451; Fulton

However, all these prior art attempts at making poker interesting and challenging have not been successful.

I have determined that a more natural method and game of transitioning between standard/regular play and the bonus play is desirable. In addition, I have also determined that this more natural method should be easy to understand by the player. Further, I have determined that his more natural method of transitioning from standard play to bonus player should be visually presentable to the player. This visual presentation should allow the player to easily identify the current status of play, and to at least, provide the player with the feeling of being able to predict when the player will become eligible for the bonus round of play.

SUMMARY OF THE INVENTION

It is a feature and advantage of the present invention to include a more natural method and game of transitioning between standard/regular play and the bonus play.

It is another feature and advantage of the present invention to include this more natural method that is easy to understand by the player.

It is another feature and advantage of the present invention to include this more natural method of transitioning from standard play to bonus player by being visually presentable to the player.

It is another feature and advantage of the present invention to allow the player to easily identify the current status of play, and to at least, provide the player with the feeling of being able to predict when the player will become eligible for the bonus or bonus round of play.

In accordance with one embodiment of the invention, a modified card game provides a player the ability to sequentially become eligible for a bonus round of play. The game includes dealing a set of cards to the player for playing the modified card game in accordance with a predetermined number of positions, determining whether a designated card appears in cards dealt to the player, and if so, assigning a position corresponding to the dealt card with an indicator, and repeating this process until the card game is completed. The game also includes determining whether all of the predetermined number of positions have been assigned with the indicator, and if so, playing the modified card game in accordance with a bonus round for enhanced enjoyment/excitement.

In accordance with another embodiment of the invention, a modified card game provides a player the ability to sequentially become eligible for a bonus round of play. The game includes dealing a set of cards to the player for playing the modified card game in accordance with a predetermined number of positions, determining whether a designated card appears in cards dealt to the player, and if so, assigning a position corresponding to the dealt card with an indicator, and repeating this process until the card game is completed. The game also includes determining whether all of the predetermined number of positions have been assigned with the indicator, and if so, awarding the player a bonus for enhanced enjoyment/excitement.

In accordance with another embodiment of the invention, a modified card game provides a player the ability to sequentially become eligible for a bonus round of play. The game includes assigning a winning position with an indicator until a predetermined number of the winning positions have been assigned with the indicator. When the predetermined number of the winning positions have been assigned with the indicator, playing the bonus round of play.

According to another embodiment of the invention, a modified game for two players provides the ability for a player to sequentially become eligible for a bonus round of play. The game includes assigning a first set of numbers eligible for selection by a first player, and selecting a second set of numbers by a second player, where the second set of numbers is a first subset of the first set of numbers. The game also includes selecting a third set of numbers by the first player, where the third set of numbers is a second subset of the first set of numbers, and the second set of numbers is a third subset less than or equal to the third set of numbers. The game also includes assigning the second set of numbers with an indicator, comparing the third set of numbers against the second set of numbers to play the game, and when all the first set of numbers have been assigned with the indicator, playing the bonus round of play or awarding a bonus.

According to another embodiment of the invention, a computer readable medium includes instructions executed by a computer. The instructions instruct the computer to execute a modified card game wherein a player sequentially becomes eligible for a bonus or a bonus round of play. The instructions include dealing a set of cards to the player for playing the modified card game in accordance with a predetermined number of positions, determining whether a designated card appears in cards dealt to the player, and if so, assigning a position corresponding to the dealt card with an indicator, and repeating this process until the card game is completed. The instructions also include determining whether all of the predetermined number of positions have been assigned with the indicator, and if so, playing the modified card game in accordance with a bonus round for enhanced enjoyment/excitement.

These, together with other objects and advantages which will be subsequently apparent, reside in the details of construction and operation as more fully herein described and claimed, with reference being had to the accompanying drawings forming a part hereof wherein like numerals refer to like elements throughout.

BRIEF DESCRIPTION OF THE DRAWINGS

FIG. 1 illustrates a five payoff column table with an additional sixth bonus column in accordance with the modified game;

BEST MODE FOR CARRYING OUT THE INVENTION

Figure 2:
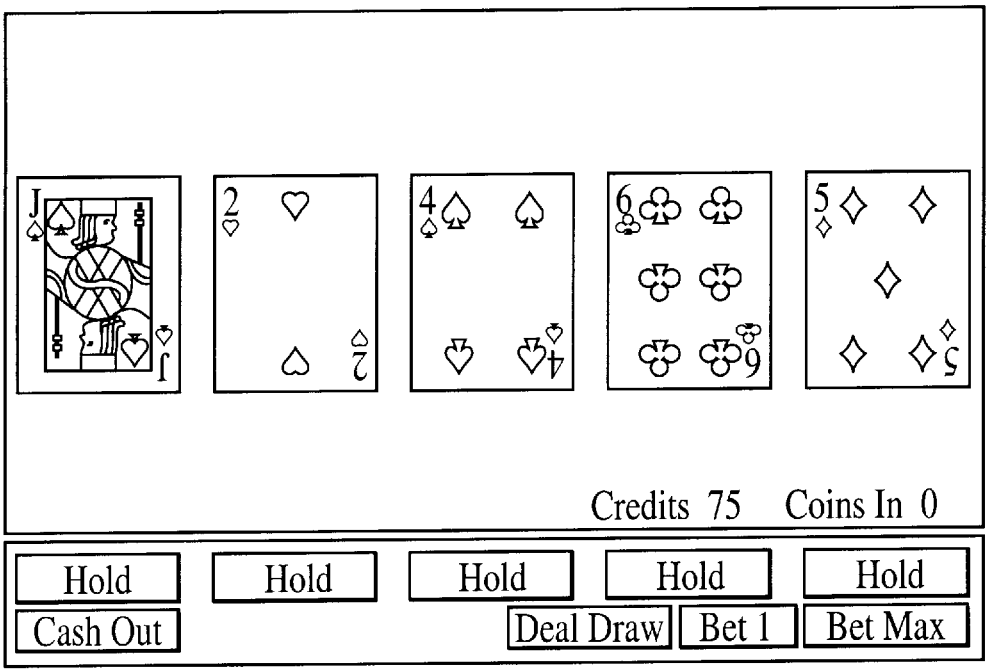
FIG. 2 is an illustration of a first game of video poker gold where all cards being dealt are not one of the designated cards.

The following describes the basic components and rules for playing the VIDEO POKER GOLD (or "GO FOR THE GOLD") card game and computer system. GO FOR THE GOLD is a video poker variant which creates a sixth or additional payoff column—The Golden Bonus Payoff Column, see FIG. 1. Note that while FIG. 1 illustrates a five payoff column table with the addition sixth bonus column, any number of payoff columns can be utilized so long as an additional bonus payoff column is also provided as explained below.

When the player enters a predesignated or maximum coinage (e.g., 5 coins), the deck will have one card (e.g., the ace of spades) assigned as the Golden Card. Each time the golden card appears, the position that it appears in is framed in gold. This frame of gold does not disappear from the screen with the next hand dealt, but in fact, it stays on the screen for as many deals as it takes to reach the Golden Bonus Round.

When the Golden Card appears again, in another position, that position will also be framed in gold until eventually each of the five card-positions of video poker are framed in gold. When all five positions are framed in gold the player has reached the Golden Bonus Round. At this point, The Golden Payoff Column will highlight itself and the playing surface will turn gold.

The player will then play one hand of video poker where there is no need to enter any money or use any credits—and the rewards for this Golden Poker Hand will follow the Golden Bonus Payoff Column.

Alternatively, each time the player wins a game which has a predesignated positional format, a golden card appears in the winning position and is framed in gold. This frame of gold does not disappear from the screen with the next hand dealt, but in fact, it stays on the screen for as many deals as it takes to reach the Golden Bonus Round.

According to this alternative, when the Golden Card appears again, in another winning position, that second winning position will also be framed in gold until eventually each of the possible winning positions of the game are framed in gold. When all winning positions are framed in gold the player has reached the Golden Bonus Round. At this point, The Golden Payoff Column will highlight itself and the playing surface will turn gold. The player will then play one game where there is no need to enter any money or use any credits—and the rewards for this Golden Game will follow the Golden Bonus Payoff Column or other similar bonus scheme.

As an additional alternative to playing the GO FOR THE GOLD Poker game, instead of providing a bonus round at which time the player has the opportunity of playing an additional round of poker for a greatly enhanced award, the player may simply cash-in awards (e.g., coins) that have accumulated for each time the gold frame appears in the five card positions.

According to this alternative, every time the gold frame appears, either randomly, according to winning position or other predetermined criteria, an award or coin is assigned to the player. When all positions (e.g., all five poker hand positions) are highlighted with the gold frames, the player then has the option of cashing in all coins that have accumulated as a result of the appearance of the gold frame in all positions.

Coins may be cumulatively assigned to a card position so that even though a gold frame has already appeared in a specific position once, additional coins are awarded in accordance with the number of times the gold frame has appeared in the specific position. Alternatively, coins may only be awarded the first time the gold frame appears for each position, and therefore, the number of coins that are automatically awarded to the player according to this variation are the number of card positions or a multiple of the number of card positions.

Yet another modification or alternative is to allow the player to play a bonus round using a predetermined number of points, and also obtain an automatic payoff when the gold frame appears in all positions using another predetermined number of coins. The number of coins that may be simultaneously be allocated to the different games may be player selected, house selected or a combination thereof.

Probalistic Details for Video Poker Gold

If one card in a deck of 52 playing cards is designated the Golden Card it will appear in one of the five positions on a video poker screen, approximately once every 6 deals—given that the average video poker hand exposes approximately 8 cards per deal, that is, the average draw is 3 cards.

Since the Golden Card can reappear in the same position as it appeared previously, it will take, on average, twelve appearances to frame all five card-positions in gold. Since each appearance occurs approximately each six deals it should take, on average, seventy-two deals to reach the Golden Bonus Round. In fact, the computed average number of deals to reach the Golden Bonus Round is approximately 75, and ranges approximately between 12–250.

If the normal video poker payoff table is modified to hold approximately an additional 6–7% then each 72 deals at maximum coinage (5 coins) 360 coins will have been wagered and 0.06–0.07 times 360 coins=approximately 25 coins. Which means that there will be approximately 25 coins available to bet for the player in the Golden Bonus Round, which means that the Golden Bonus Payoff Column can be five times the 5 coin payoff column. For example, the golden payoff bonus could be as follows:

| | |
|---|---|
| Royal Flush | 25,000 coins |
| Straight Flush | 1,250 coins |
| Four-of-a-Kind | 625 coins |
| Full House | 225 coins |
| Flush | 150 coins |
| Straight | 100 coins |
| Three-of-a-Kind | 75 coins |
| Two Pair | 50 coins |
| Kings or Aces | 25 coins |

Alternatively, the following payoff table is also possible:

| | |
|---|---|
| Royal Flush | 25,000 coins |
| Straight Flush | 1,250 coins |
| Four-of-a-Kind | 625 coins |
| Full House | 225 coins |
| Flush | 150 coins |
| Straight | 100 coins |
| Three-of-a-Kind | 75 coins |
| Two Pair | 25 coins |
| Pair of Jacks or better | 25 coins |

Thus, the Golden Bonus Round provides a much higher return for the player, thereby dramatically increasing the excitement for playing the game. Further other payoff tables may also be used such as the payoff table disclosed in U.S. patent application Ser. No. 08/716,114, filed Sept. 19, 1996, to Singer et al., entitled "PICK 'EM POKER CARD/TOURNAMENT GAME AND INTERACTIVE NETWORK COMPUTER SYSTEM FOR IMPLEMENTING SAME," incorporated herein by reference.

Advantages (1) The player is induced to stay and play. Once the player has two or three Golden Framed Positions there will be a strong tendency to stay the course and reach the Golden Bonus Round.

(2) With a Golden Bonus Round reached, on the average, each 72 games, the playing time between bonus rounds will average 12 minutes. Although sometimes it will be much shorter and sometimes longer.

(3) A progressive Jackpot can be included for a Royal Flush using the Golden Ace of Spades. According to this scenario, the normal rounds of video poker are used to fund the bonus round of play, and the bonus round of play is then used to fund the progressive jackpot. For example, 7% of the normal rounds of video poker is allocated for the bonus round of play which provides approximately 5 times greater of a return than normal play for all card hands. Next, 7% of the bonus round of play can then be used to fund the progressive jackpot which can be awarded based on any predetermined criteria, such as a specific card hand, a specific winning card hand, and the like.

(4) The hardware can be given away to the casinos—for the bonus round can fund the lease/rental of the machine. Remember, the 25 coins bet in the Golden Bonus Round have a normal payoff table with an 8.95% hold enough to fund the Progressive Jackpot and to provide revenue to the hardware vendor.

(5) Dead hours during the hours of operation at the casino can be addressed by giving the video poker machines with the ability to start with one or two positions Framed in Gold.

(6) Dead areas in the casino floor space can be addressed by giving the video poker machines with the ability to start with one or two positions Framed in Gold.

FIG. 2 is an illustration of a first game of video poker gold where all cards being dealt are not one of the designated cards, e.g., no ace of spades, to obtain a gold frame.

Figure 3:
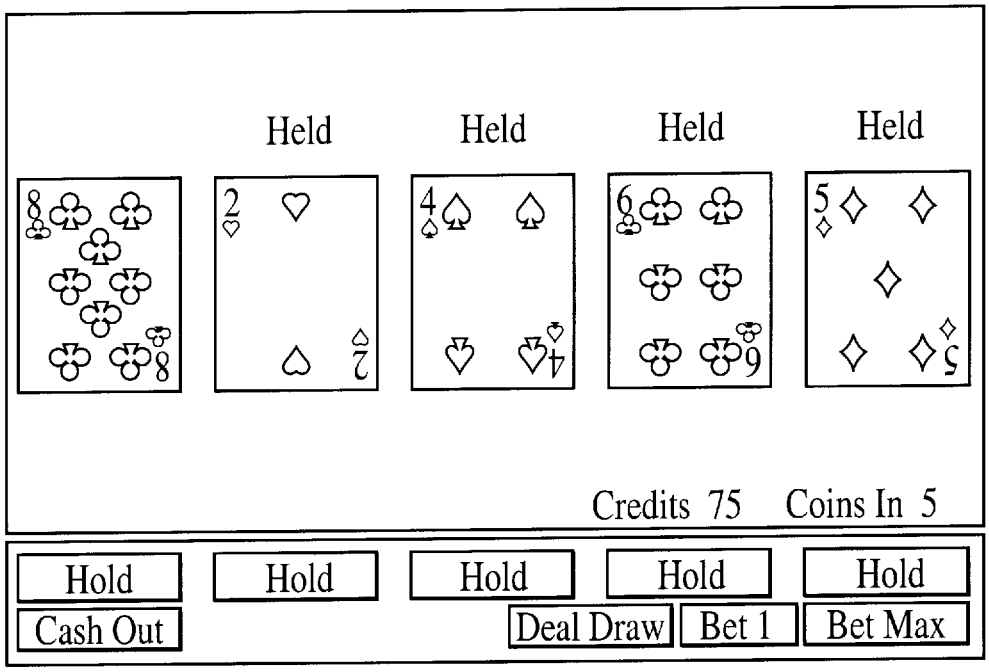
FIG. 3 is an illustration of the poker game illustrated in FIG. 2 where four of the cards have been held or kept by the player, and one of the cards has been replaced with a new card.

FIG. 3 is an illustration of the poker game illustrated in FIG. 2 where four of the cards have been held or kept by the player, and one of the cards has been replaced with a new card, the 8 of clubs. In this game, the player loses, since the player did not receive a combination of cards that provide any reward.

Figure 4:
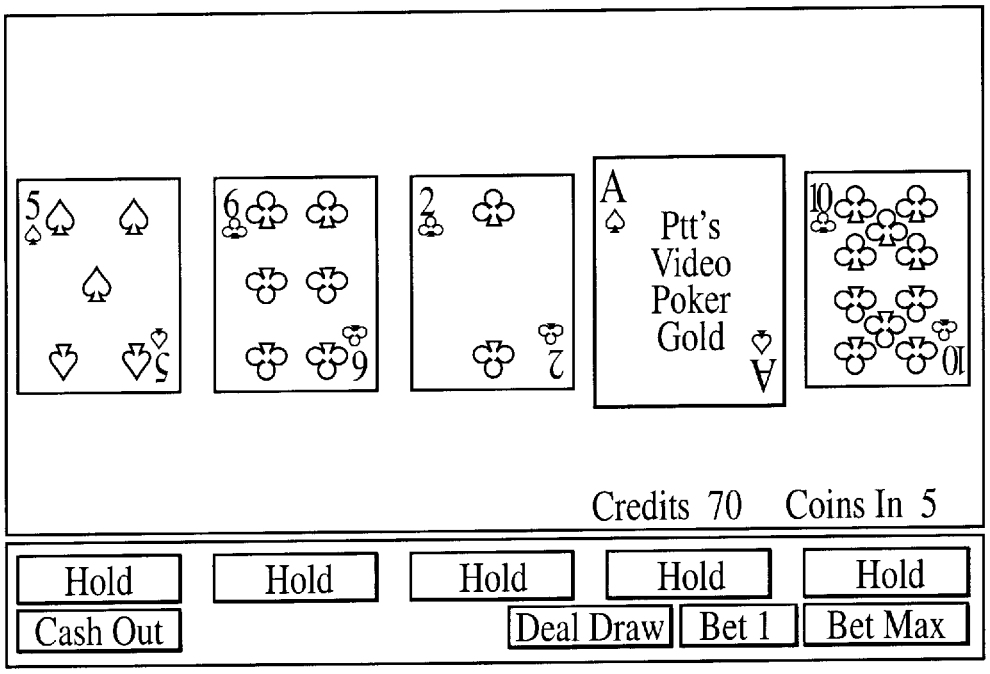
FIG. 4 is an illustration of another game of video poker gold where the card in the fourth position from the left is the designated card for obtaining a gold frame for the bonus round.

FIG. 4 is an illustration of another game of video poker gold where the card in the fourth position from the left is an ace of spades, which is the designated card for obtaining a gold frame for the bonus round.

Figure 5:
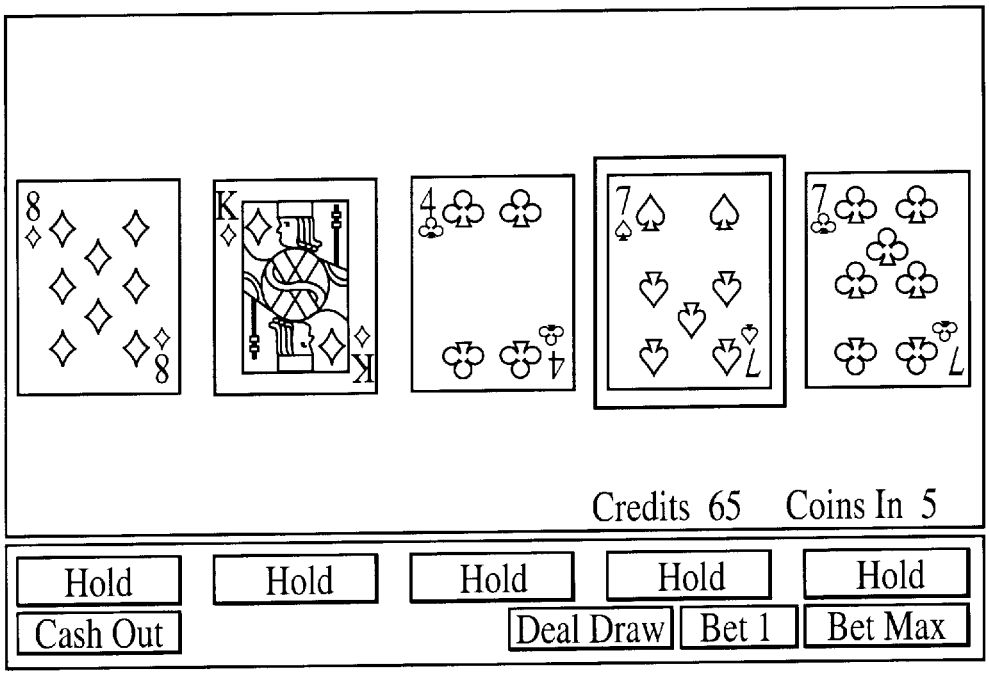
FIG. 5 illustrates another game of video poker gold where the gold frame has been illuminated as a result of a previous played game illustrated in FIG. 4.

FIG. 5 illustrates another game of video poker gold where the gold frame has been illuminated as a result of a previous played game illustrated in FIG. 4. In FIG. 5, the 7 of spades includes the gold frame. In addition, the credits have been appropriately deducted from the previous game since the player has lost the previous game.

Figure 6:
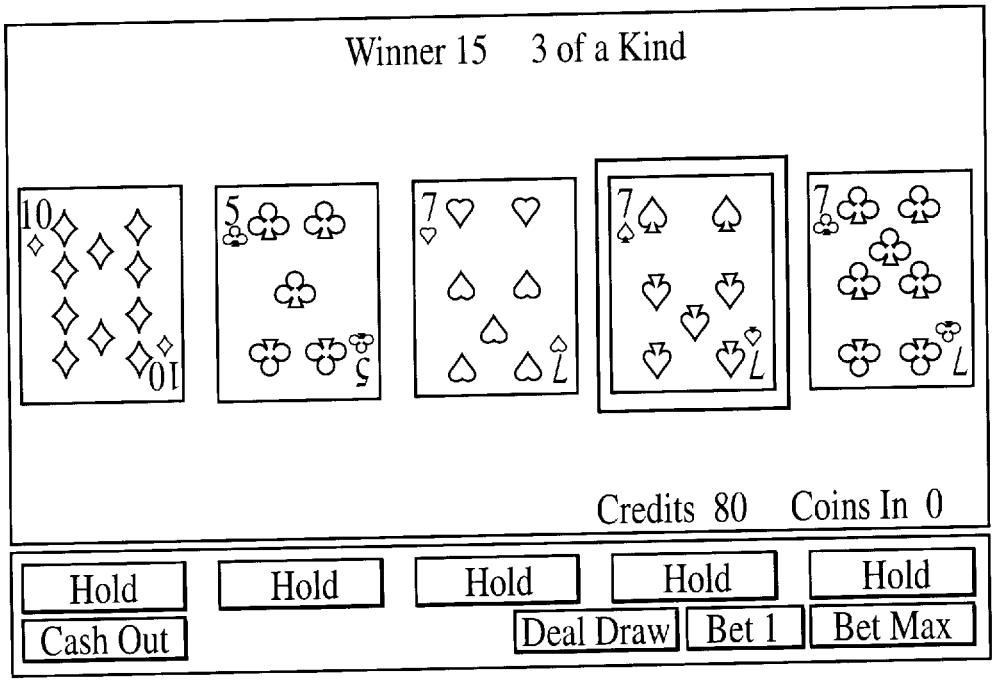
FIG. 6 illustrates the final hand of the game illustrated in FIG. 5 where the player held a 7 of spades and a 7 of clubs illustrated in FIG. 5 and received additional cards, the 10 of diamonds, 5 of clubs and 7 of hearts.

FIG. 6 illustrates the final hand of the game illustrated in FIG. 5 where the player held a 7 of spades and a 7 of clubs illustrated in FIG. 5 and received additional cards, the 10 of diamonds, 5 of clubs and 7 of hearts. Thus, the game ended with a three of a kind hand for the player, and the player won 15 credits. Note that the credits have been adjusted by 15 as well.

Figure 7:
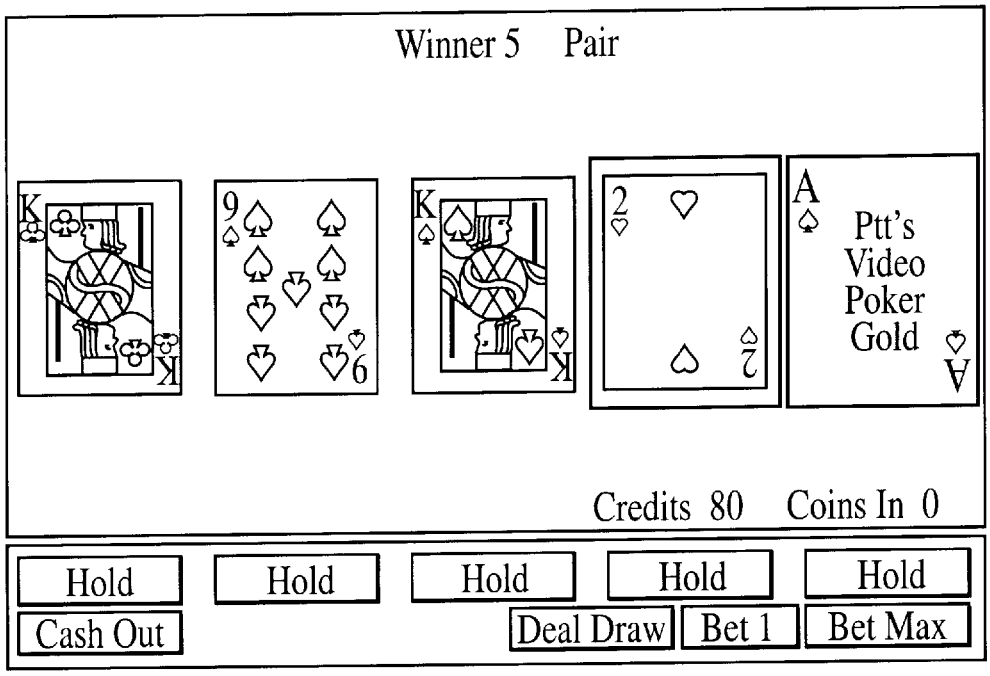
FIG. 7 is an illustration of another game of video gold poker where the player has received an ace of spades, the designated card, in a second position.

FIG. 7 is an illustration of another game of video gold poker where the player has received an ace of spades, the designated card, in a second position. The player has additionally won in this game by having a pair of kings. The credits have not yet been adjusted in FIG. 7 to account for the additional winning game of the player.

Figure 8:
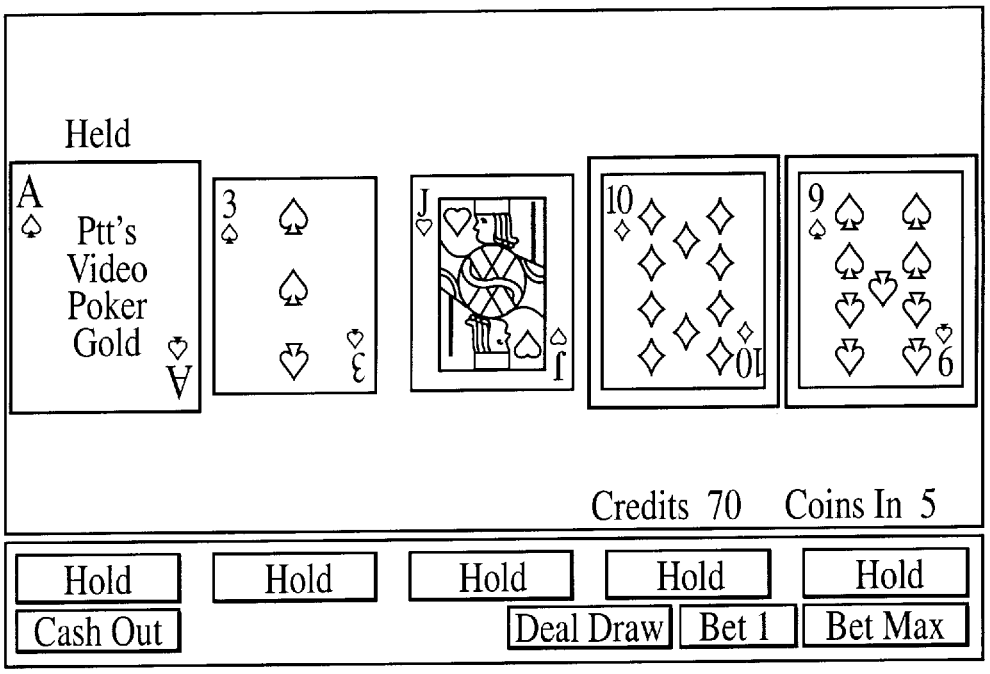
FIG. 8 is an illustration of another game of video gold poker with an additional gold frame in the location of the 9 of spades.

FIG. 8 is an illustration of another game of video gold poker. FIG. 8 illustrates the additional gold frame in the location of the 9 of spades. The player has also received an additional ace of spades in the first position of the cards.

Figure 9:
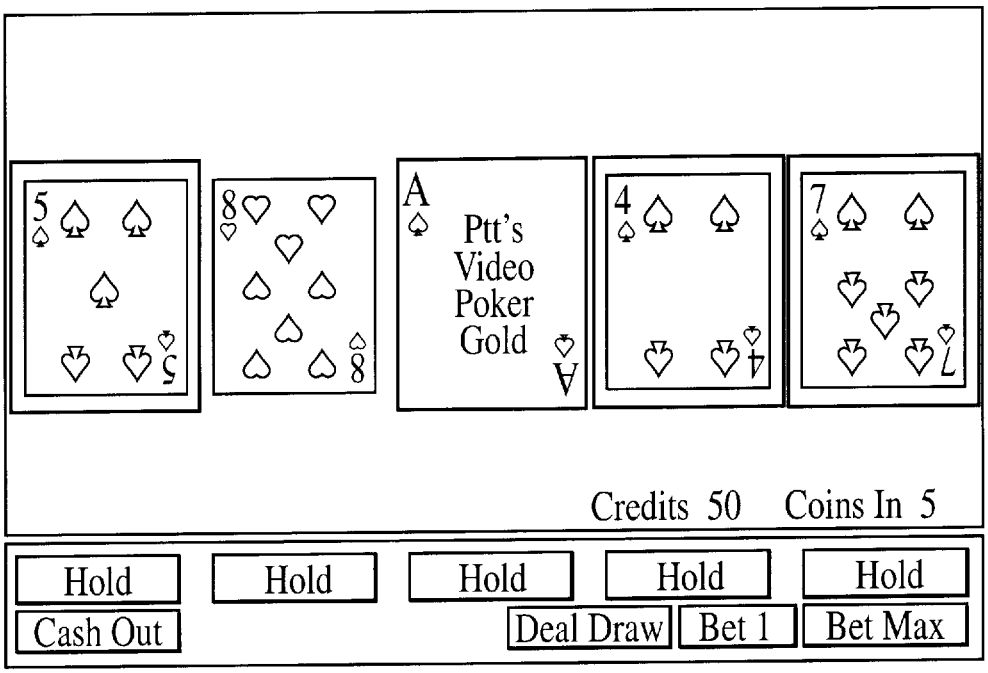
FIG. 9 is an illustration of an additional game of video gold poker where the third gold frame is illuminated in the position of the 5 of spades.

FIG. 9 is an illustration of an additional game of video gold poker where the third gold frame is illuminated in the position of the 5 of spades. In addition, the player has also received an additional ace of spades in the third location.

Figure 10:
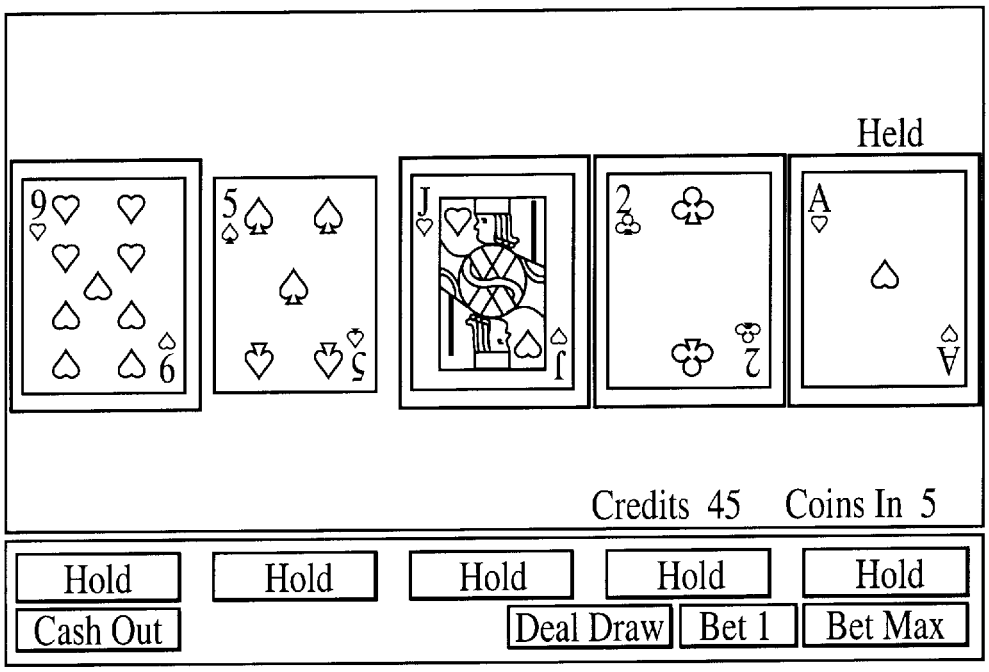
FIG. 10 is an illustration of an additional game of video gold poker where all the current gold frames are illuminated.

FIG. 10 is an illustration of an additional game of video gold poker where all the current gold frames are illuminated. As illustrated in FIG. 10, only the second position where the 5 of spades is located is missing the gold bar.

Figure 11:
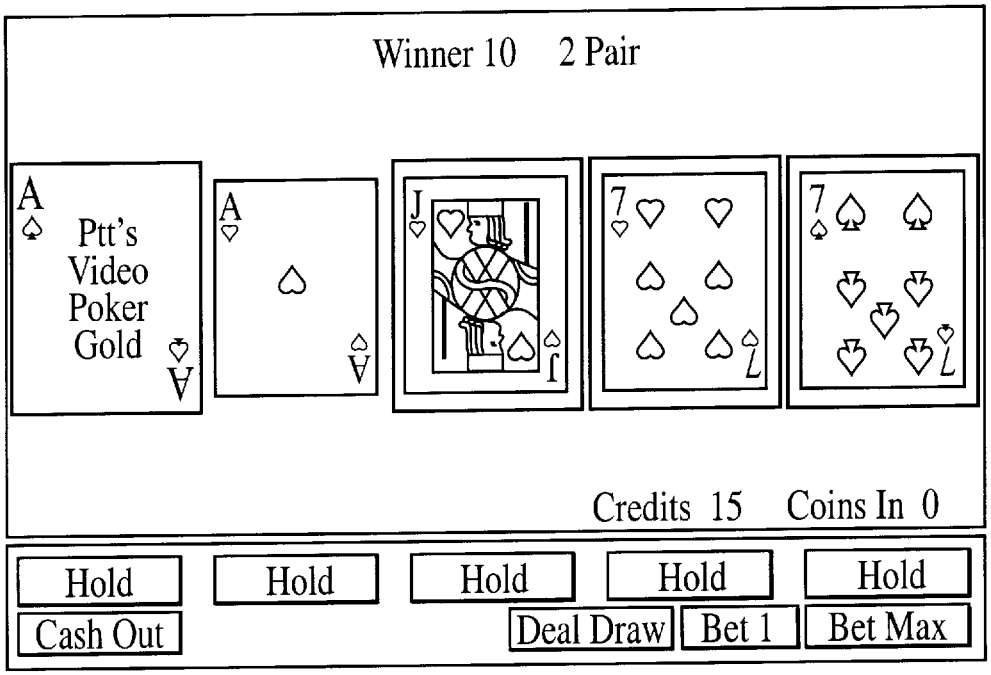
FIG. 11 is an illustration of an additional game of video gold poker where the player has received the designated card in a position that already received the gold frame.

FIG. 11 is an illustration of an additional game of video gold poker where the player has received an ace of spades, the designated card, in a position that already received the gold frame. In this situation, there are various options which may be chosen. The first option is that the gold bar in the first position remains in tact. A second alternative is that only the gold bar in the first position is removed by placement of designated card in a position which already received the designated card/gold frame. A third alternative is to remove all the gold frames from the screen and to begin the process over again until the player has received the designated card in each of the positions only once. A fourth alternative is to display one or more gold coins above the position for which the gold frame has appeared, as described above or in consonance with the above three alternatives.

Figure 12:
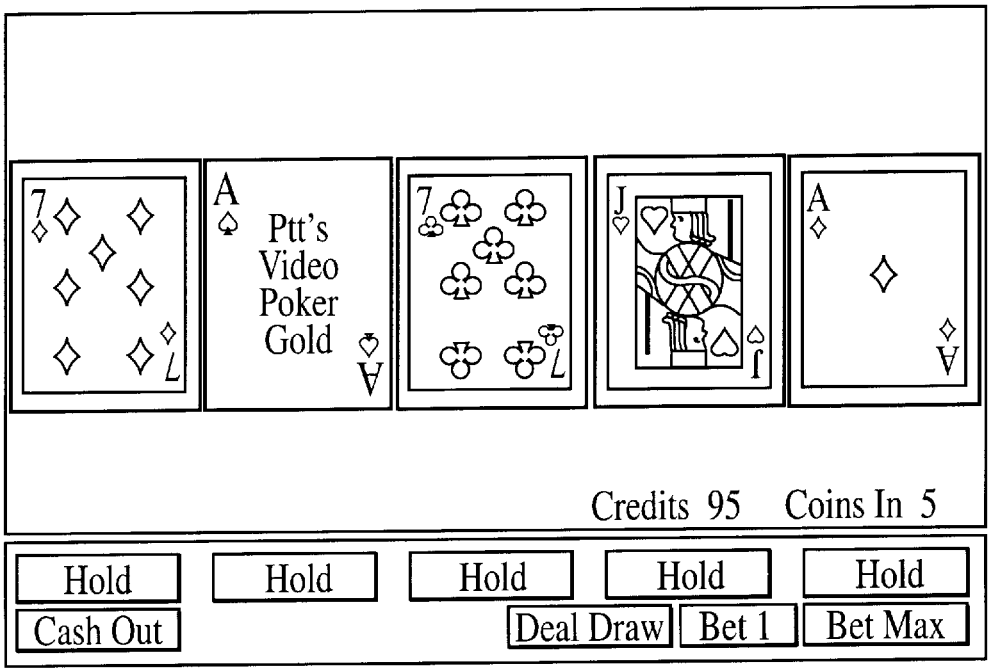
FIG. 12 is an illustration of the video poker gold game where the final designated card has been placed in the final position.

FIG. 12 is an illustration of the video poker gold game where the final designated card, e.g., the ace of spades, has been placed in the final position.

Figure 13:
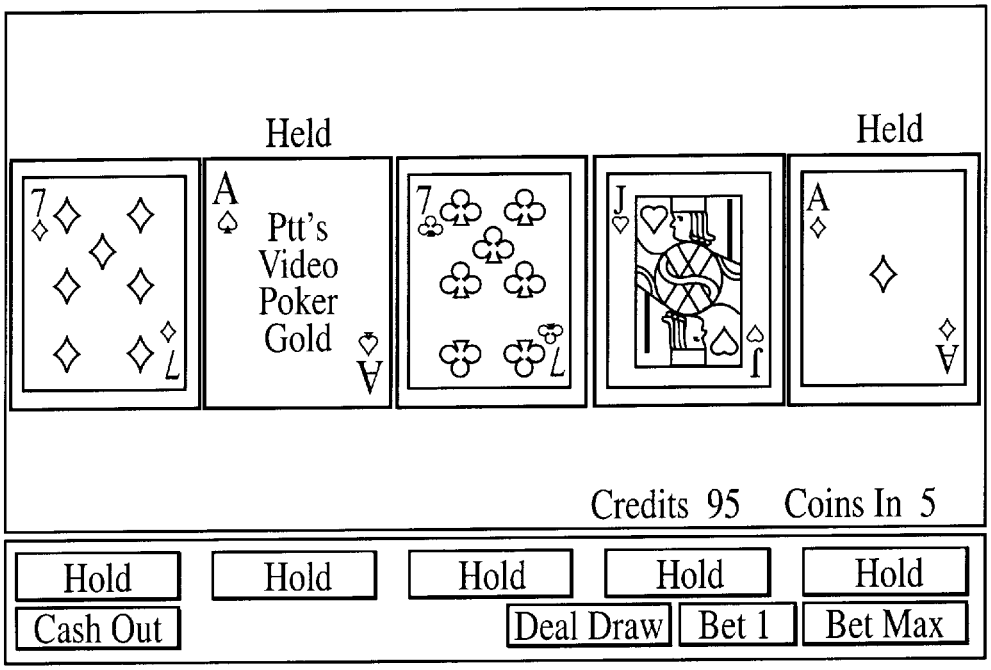
FIG. 13 is an illustration of the player selecting only the ace of spades and the ace of diamonds for the video poker gold game.

FIG. 13 is an illustration of the player selecting only the ace of spades and the ace of diamonds for the video poker gold game, which are the cards originally dealt in FIG. 12.

Figure 14:
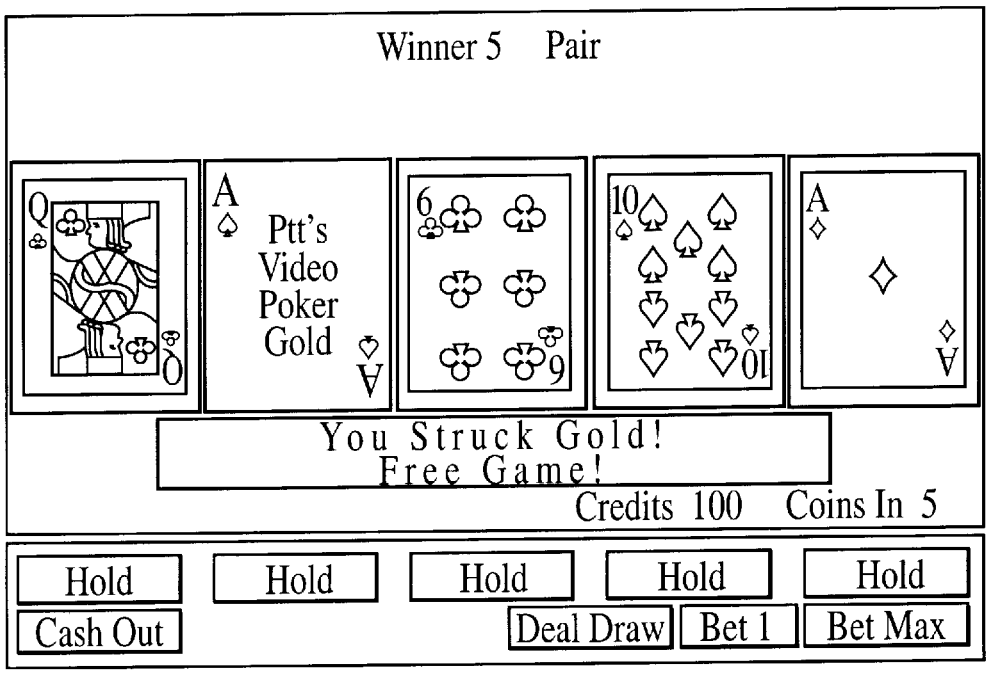
FIG. 14 is an illustration of the final round of video poker gold has been played and the player has one based upon the pair of aces.

FIG. 14 is an illustration of the final round of video poker gold has been played and the player has one based upon the pair of aces. In addition, the video gold computer system informs the player that all five gold frames are now present and that the player is receiving the free/bonus game.

Figure 15:
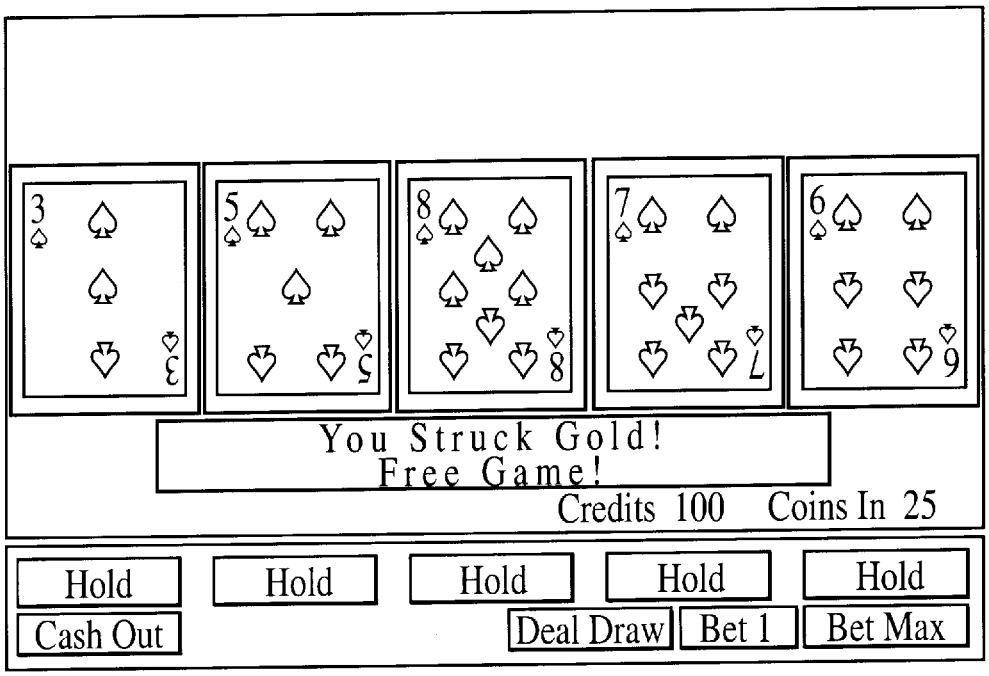
FIG. 15 is an illustration of the cards that have been dealt to the player in the video poker gold game for the bonus round.

FIG. 15 is an illustration of the cards that have been dealt to the player in the video poker gold game for the bonus round. Note that the coins in is 25, which is 5 times the amount of coins that are regularly entered by the player. These 25 coins that have been entered are bonus coins which have been provided by the system and which are not required or deducted from the player.

Figure 16:
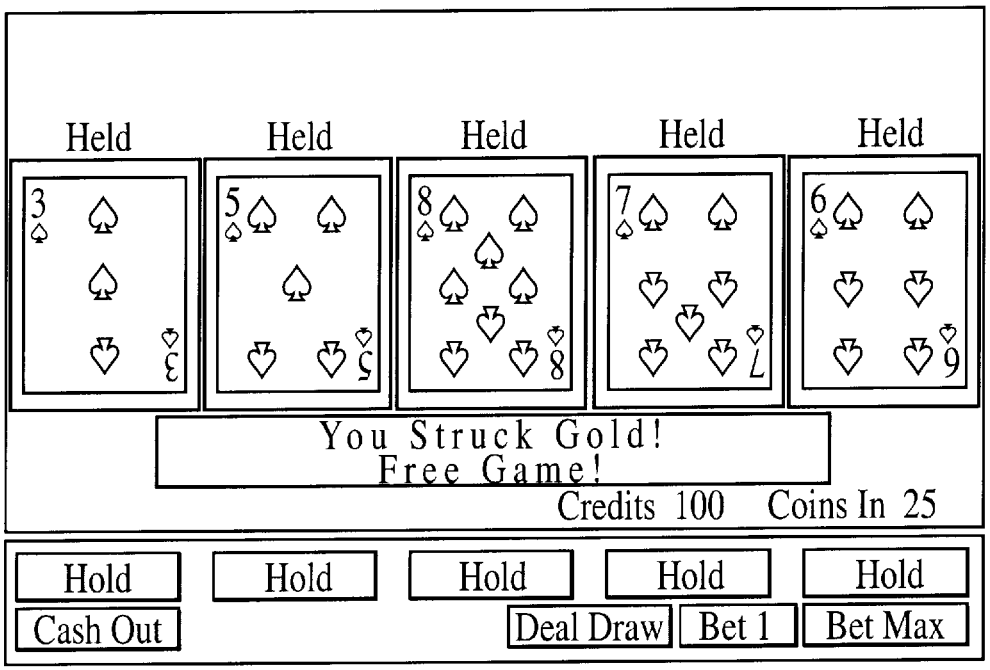
FIG. 16 is the result of the player holding all 5 cards that have been dealt for the bonus round illustrated in FIG. 15.

FIG. 16 is the result of the player holding all 5 cards that have been dealt for the bonus round illustrated in FIG. 15. As can be seen from FIG. 16, all cards represent a flush.

Figure 17:
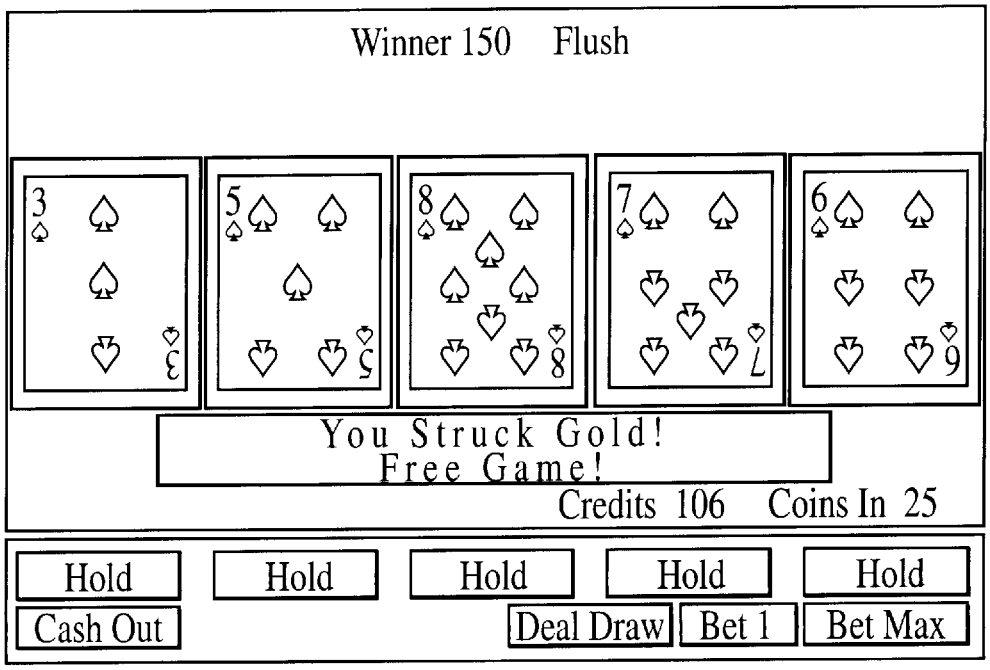
FIG. 17 illustrates the player winning the bonus round.

FIG. 17 illustrates the player winning the bonus round for the flush. In this situation, the player has won 5 times the normal amount of coins which can readily be calculated from the golden bonus column in the award table illustrated in FIG. 1 for a flush. Note that the computer is in the process of posting the 150 winning credits to the original player credits of 100.

Figure 18:
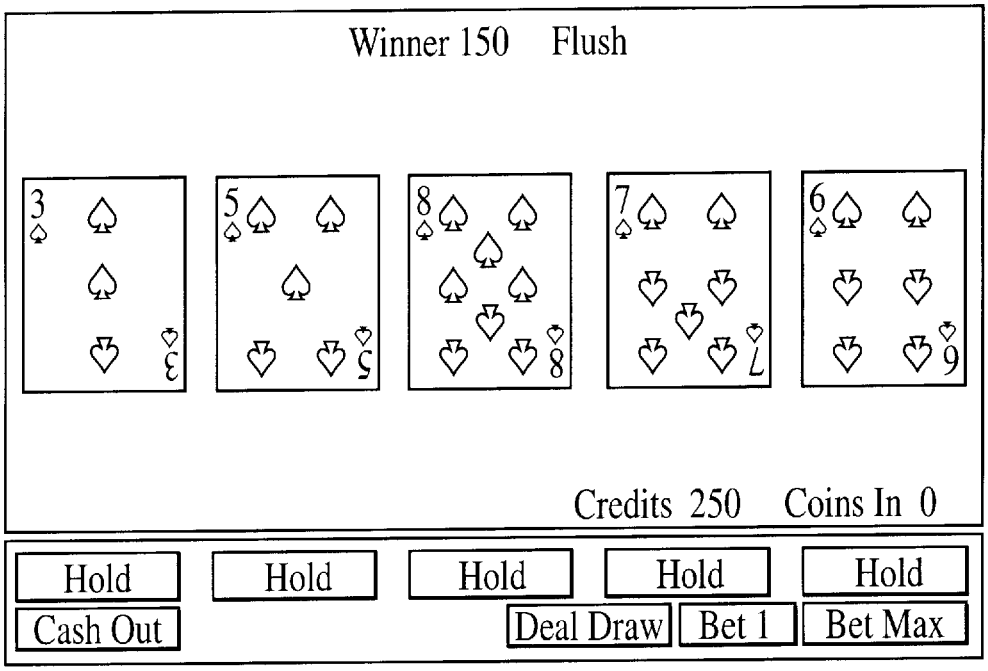
FIG. 18 is the final display after the player has won in the bonus round.

FIG. 18 is the final display after the player has won 150 credits in the bonus round as a result of the flush. As illustrated in FIG. 18, the player has been fully credited 150 credits totalling 250 credits.

Figure 19:
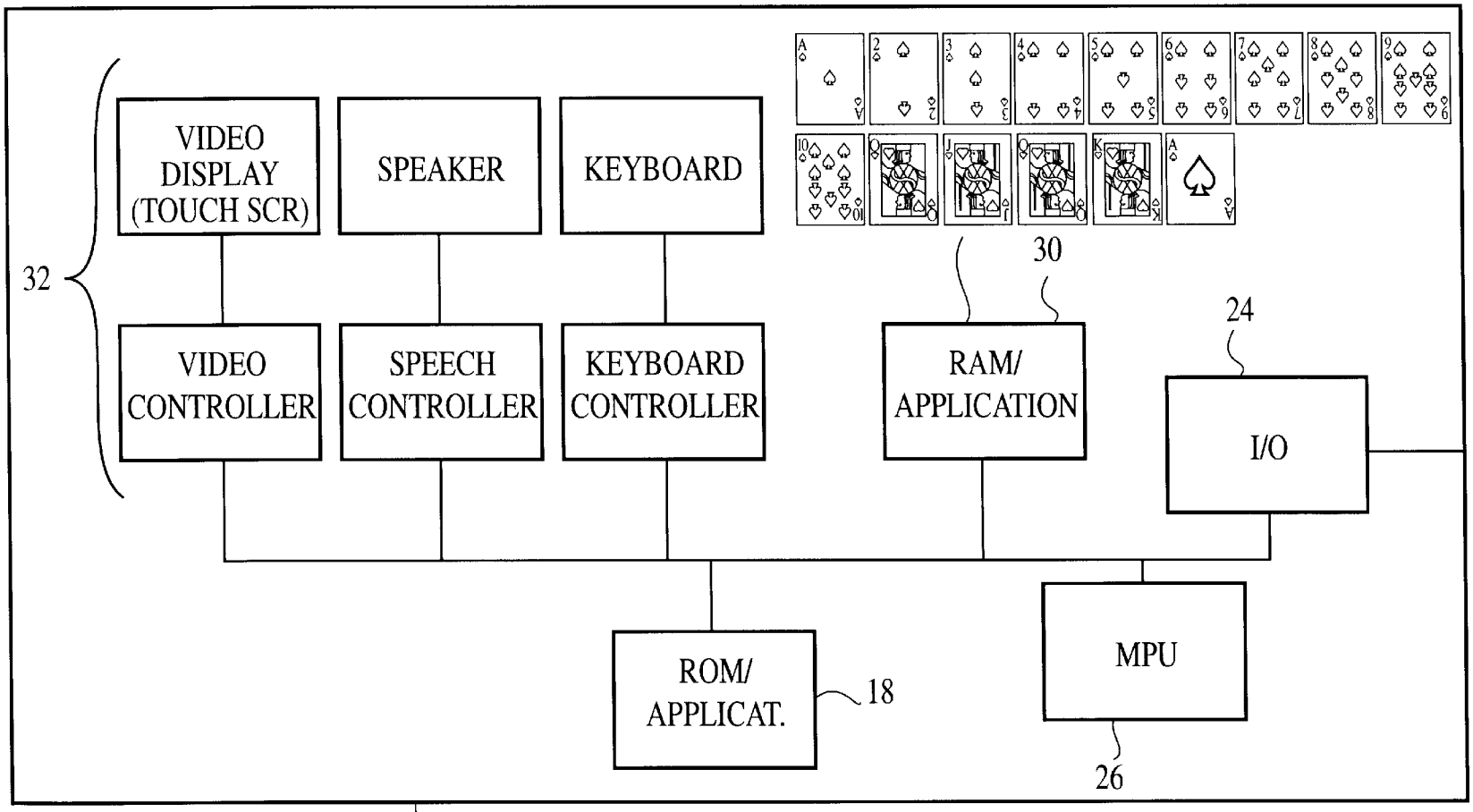
FIG. 19 is an illustration of the hardware utilized in the modified card game computer system in a stand-alone environment.

FIG. 19 is an illustration of the hardware utilized in the GO FOR THE GOLD game computer system in a stand-alone environment. In FIG. 19, computer hardware 16 includes input/output (I/O) device 24 providing the gateway or connection from computer hardware 16 to possible external devices. For example, input/output device 24 may connect to other computers in a network environment. See, for example, U.S. Provisional patents Ser. No. 60/011,574, filed Feb. 13, 1996, Ser. No. 60/011,573, filed Feb. 13, 1996, Ser. No. 60/013,798, filed Mar. 21, 1996, Ser. No. 60/013,801, filed Mar. 21, 1996, and Ser. No. 60/017,432, filed May 9, 1996, incorporated herein by reference.

Main processing unit 26 performs the execution of the computer implemented functions for the GO FOR THE GOLD game computer system. Computer hardware 16 also includes read only memory (ROM) 18 which is used, for example, to store the card game instructions, some of the basic routines for initiating computer hardware 16, as well as other common functions of main processing unit 26 including the computer games and rules that implement video poker gold, and other games. A sample software program that implements the GO FOR THE GOLD POKER game is included in the Appendix of U.S. provisional patent application Ser. No. 60/023,745, filed on Aug. 8, 1996, incorporated herein by reference. Computer hardware 16 also includes random access memory (RAM) 30 which is used, for example, for easy access to execute the card game instructions, some of the basic routines for booting computer hardware 16, as well as other common functions of main processing unit 26 that are generally retrieved from ROM 18 where this information is stored on a more permanent basis.

Computer hardware 16 also includes user interface devices 32 such as a video display, a speaker and/or a keyboard. Each of these user interface devices also includes respective controllers for controlling the transmission of the required data for properly utilizing the user interface devices.

The uniqueness of GO FOR THE GOLD is that it is very visual and very obvious to the player. When the designated card (e.g., ace of spades) appears in any position, that position goes gold. It is therefore easy for the player to identify and understand. At the same time, GO FOR THE GOLD has the ability of allowing the casino or game manager to manipulate the game starting position so that the players could start with one or two gold frames already. This provides the casino the advantage of modifying the play of the game based upon dead times and dead areas in the casino.

GO FOR THE GOLD is applicable not only in the video poker environment, but in other game areas as well. For example, SLOT-TAC-TOE, PICK 'EM POKER and WHICH WAY TO GO POKER could all be modified for this game. Other new games which are suitable, particularly, in the computer environment, include Additionally, this game could also be used in connection with With PICK 'EM POKER (see PICK 'EM POKER COMPUTER GAME, by Anthony M. Singer et al., filed on May 9, 1996 as U.S. provisional patent application Ser. No. 60/017,432; and PICK 'EM POKER TOURNAMENT GAME AND INTERACTIVE NETWORK COMPUTER SYSTEM FOR IMPLEMENTING SAME, by Anthony M. Singer et al., filed on Jun. 14, 1996 as U.S. provisional patent application Ser. No. 60/019,747, both of which are hereby incorporated by reference), the game would operate very similarly to video poker.

With SLOT-TAC-TOE (see COMBINATION TIC-TAC-TOE GAME AND NUMBERED CARD COMPETITION, by Howard M. Marks filed on Feb. 1, 1996 as U.S. patent application Ser. No. 08/595,133, and SLOT-TAC-TOE GAME AND SPIN-AND-WIN COMPUTER SYSTEM to Howard M. Marks, Anthony M. Singer, filed on Feb. 13, 1996 as U.S. provisional patent application Ser. No. 60/011,573, incorporated herein by reference), there are 7 winning positions. That is, 3, 4, 5, 6, 7, 8 and 9. A player can win in 3 or more moves. The computer then highlights all the last positions that the player has won. For example, if the player wins in seven moves, then the move on the seventh place which is the winning move is highlighted and will stay lit. Once all positions have been highlighted, then the player is given a bonus round which is preferably free, but could also cost.

With WHICH WAY TO GO poker, it is the same game concept as PICK 'EM POKER for enhanced play/award. Instead of getting two cards as in PICK 'EM POKER the player gets one card. However, the player has the choice of where to put the card. Either the player puts the card with hand 1 that is horizontal or hand 2 that is vertical. Each space will be highlighted when the ace of spades is placed thereon. The bonus round will appear once all spaces have been occupied by the ace of spades. Since the player has more freedom in determining the spaces to place the ace of spades, the probabilities will be worked out appropriately. A detailed description of WHICH WAY TO GO poker is provided in copending provisional patent application, entitled "COMPUTER IMPLEMENTED GAMES AND CARD GAMES," to Howard M. Marks, Anthony M. Singer, filed concurrently with this provisional patent application.

Another example where GO FOR THE GOLD has applicability is for the game called Keno. In Keno, a player selects a subset of numbers from a list of 80 numbers. The minimum number of numbers a player must select is generally five. The computer or system then selects 20 numbers from the list of 80. If all or most of the players subset of numbers is within the list of 20, then the player wins. For example, if the player chooses five numbers, there are 80 numbers in total, and the computer will chose 20 numbers. If the 5 numbers that have been chosen by the player are also chosen by the game/computer, there is a huge prize.

GO FOR THE GOLD applies to and also enhances the Keno game. For example, every time a number gets chosen by the computer (e.g., 20 of the 80 numbers are chosen), that number stays gold. Once all of the 80 positions are chosen at least once, then the player is given a bonus round. Therefore, after a certain number of Keno games, every position will get chosen because the computer keeps on randomly selecting 20 numbers. Thus, once the player has all 80 spots covered with gold, the player is given a bonus round.

Finally, the GO FOR THE GOLD game also applies to variations of the video poker game such as the standard games: deuces wild; joker poker; bonus poker; and double bonus poker, to name a few. In addition, the GO FOR THE GOLD game can also be implemented on a small hand held unit in accordance with the hardware configuration illustrated in FIG. 19, or might appear on, for example, a cellular telephone (e.g., cellular telephone display) that has been provided the hardware and programming to perform the processing of the GO FOR THE GOLD game.

The general concept of GO FOR THE GOLD is that by completing a sequence of gold designations for either the five card positions in poker (or X-number of positions in the hand for a particular card game), or the nine winning positions within SLOT-TAC-TOE (or whatever the game might be in a particular position), the player becomes eligible for a bonus round. The positions are designated with a visible gold outline/rectangle for viewing by the player.

The concept also includes the feature that the bonus is arranged such that while the player is progressing toward the bonus, the computer puts aside money from the winning and losing hands/rounds for the bonus round. Therefore, awarding the bonus is painless because the player is actually not purposely putting aside any money. The computer is taking a small fraction of the player's potential winnings/losings for the bet and setting it aside for the bonus round. Therefore, the winnings are not permanently taken from the player, but just deferred. As a result, the bonus round can provide an award profoundly greater than anything the player normally could win.

GO FOR THE GOLD provides the additional advantage that the player does not have to win a specific game to obtain the benefit of the game. Rather, even if the player loses the game, the player might still further progress to the bonus round if the designated card (e.g., the ace of spades) has been dealt to the player. Thus, the GO FOR THE GOLD game is not dependent probabilities based on a combination of cards yielding a predesignated win, but is based on, for example, the probability of merely being dealt a specific card in a specific location or winning a game in a specific location.

Eventually all positions will be filled with gold, and a bonus round awarded. Thus, even if the player discards the card according to one design of GO FOR THE GOLD, the player still gets the benefit of the card with respect to its contribution for the bonus round.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of playing a card game wherein a player sequentially becomes eligible for a bonus round of play, comprising the steps of:

(a) dealing a set of cards to the player for playing the modified card game in accordance with a predetermined number of positions;

(b) determining whether one card of the set of cards dealt to the player is a designated card, and if so, assigning one of the predetermined number of positions corresponding to the one card of the set of cards with an indicator;

(c) repeating said steps (a) and (b) until the modified card game is completed;

(d) determining whether all of the predetermined number of positions have been assigned with the indicator; and (e) when said step (d) indicates that all of the predetermined number of positions have been assigned with the indicator, playing the modified card game in accordance with a bonus round resulting in a card hand.

2. The method according to claim 1, further comprising the step of repeatedly performing said steps (a)–(d) until the player has either completed playing the modified card game or until all of the predetermined number of positions have been assigned with the indicator.

3. The method according to claim 1, further comprising the step of comparing the card hand to a predetermined winning schedule.

4. The method according to claim 1, wherein the bonus round requires no tokens.

5. The method according to claim 1, wherein the bonus round provides an award greater than that of other rounds of the modified card game.

6. The method according to claim 1, wherein said determining step (b) determines whether a designated card appears in one card of the set of cards dealt to the player regardless of whether the player was successful in winning the modified card game.

7. The method according to claim 1, further comprising the steps of:

(1) requiring the player to enter a predetermined number of tokens for each play of the modified card game;

(2) allocating a portion of the predetermined number of tokens exclusively for the bonus round.

8. The method according to claim 1, wherein said method is implemented on a hand held computer unit.

9. The method according to claim 1, wherein said method is implemented on a cellular telephone.

10. The method according to claim 1, further comprising the step of removing the indicator assigned to at least one of the predetermined number of positions when the designated card appears in the one card of the set of cards dealt to the player another time.

11. The method according to claim 1, wherein the bonus round provides an award five times greater than that of other rounds of the modified card game.

12. The method according to claim 1, wherein the bonus round is used to fund a progressive jackpot that is awarded to the player based upon predetermined criteria.

13. A method of playing a modified poker card game wherein a player sequentially becomes eligible for a bonus round of play, comprising the steps of:

(a) dealing a set of cards to the player for playing the modified poker card game in accordance with a predetermined number of positions;

(b) determining whether a designated card appears in one card of the set of cards dealt to the player, and if so, assigning one of the predetermined number of positions corresponding to the one card of the set of cards with an indicator;

(c) prompting the player to keep or discard at least one of the cards;

(d) selecting whether the player is to keep or discard at least one of the cards;

(e) dealing the player additional cards to replace the cards that were discarded in said step (d);

(f) repeating said steps (a)–(e) until the modified poker card game is completed;

(g) determining whether all of the predetermined number of positions have been assigned with the indicator;

(h) when said step (g) indicates that all of the predetermined number of positions have been assigned with the indicator, playing the modified poker card game in accordance with a bonus round resulting in a card hand.

14. A method of playing a game wherein a player becomes sequentially eligible for a bonus round of play, comprising the steps of:

(a) playing the game having positions including winning and non-winning positions for a game award, the player being eligible for a game award for each game played;

(b) randomly assigning a first winning position with an indicator;

(c) repeating said steps (a)–(b) until a predetermined number of the winning positions has been assigned with the indicator;

(d) when the predetermined number of the winning positions have been assigned with the indicator, the player becoming eligible for the bonus round of play, and the player playing the bonus round of play for a bonus award.

15. A method of playing a game between at least two players, wherein at least one of the two players becomes sequentially eligible for a bonus round of play, comprising the steps of:

(a) assigning a first set of numbers eligible for selection by a first player;

(b) selecting a second set of numbers by a second player, the second set of numbers being a first subset of the first set of numbers;

(c) selecting a third set of numbers by the first player, the third set of numbers being a second subset of the first set of numbers, and the second set of numbers being a third subset less than or equal to the third set of numbers;

(d) assigning the second set of numbers with an indicator;

(e) comparing the third set of numbers against the second set of numbers to play the game;

(f) repeating steps (b)–(e) until all of the first set of numbers have been assigned with the indicator; and (g) when all of the first set of numbers have been assigned with the indicator, playing the bonus round of play.

16. A method of playing a card game wherein a player sequentially becomes eligible for a bonus, comprising the steps of:

(a) dealing a set of cards to the player for playing the modified card game in accordance with a predetermined number of positions;

(b) determining whether a designated card appears in one card of the set of cards dealt to the player, and if so, assigning one of the predetermined number of positions corresponding to the one card of the set of cards with an indicator;

(c) repeating said steps (a) and (b) until the modified card game is completed;

(d) determining whether all of the predetermined number of positions have been assigned with the indicator; and (e) when said step (d) indicates that all of the predetermined number of positions have been assigned with the indicator, awarding the player a bonus responsive thereto.

17. A computer readable medium including instructions executable by a computer, the instructions constructed for instructing the computer to execute a modified card game wherein a player sequentially becomes eligible for a bonus round of play, the instructions including:

(a) dealing a set of cards to the player for playing the modified card game in accordance with a predetermined number of positions;

(b) determining whether a designated card appears in one card of the set of cards dealt to the player, and if so, assigning one of the predetermined number of positions corresponding to the one card of the set of cards with an indicator;

(c) repeating said steps (a) and (b) until the modified card game is completed;

(d) determining whether all of the predetermined number of positions have been assigned with the indicator; and (e) when said step (d) indicates that all of the predetermined number of positions have been assigned with the indicator, playing the modified card game in accordance with a bonus round resulting in a card hand.

18. A computer system for playing a game wherein a player becomes sequentially eligible for a bonus round of play, comprising:

(a) means for dealing a set of cards to the player for playing the modified card game in accordance with a predetermined number of positions;

(b) means for determining whether a designated card appears in one card of the set of cards dealt to the player, and if so, assigning one of the predetermined number of positions corresponding to the one card of the set of cards with an indicator;

(c) means for repeating said steps (a) and (b) until the modified card game is completed;

(d) means for determining whether all of the predetermined number of positions have been assigned with the indicator; and (e) when said step (d) indicates that all of the predetermined number of positions have been assigned with the indicator, means for playing the modified card game in accordance with a bonus round resulting in a card hand.

* * * * *